US005633626A

United States Patent [19]

Cawthorne

[11] Patent Number: 5,633,626

[45] Date of Patent: May 27, 1997

[54] SELF-TESTING SECURITY SENSOR FOR MONITORING CLOSURE OF VAULT DOORS AND THE LIKE

[75] Inventor: Duane C. Cawthorne, Amarillo, Tex.

[73] Assignee: The United States of America as represented by the United States Department of Energy, Washington, D.C.

[21] Appl. No.: 520,634

[22] Filed: Aug. 29, 1995

[51] Int. Cl.[6] ..... G08B 13/08

[52] U.S. Cl. ..... 340/545; 340/515; 340/514; 340/547; 340/550; 340/551; 335/206

[58] Field of Search ..... 340/545, 546, 340/547, 514, 515, 516, 541, 551; 335/206, 207, 205; 116/12, 25, 85, 86, 100; 49/13, 14; 200/61.62, 61.93

[56] References Cited

U.S. PATENT DOCUMENTS

| | | | |
|---|---|---|---|
| 3,349,323 | 10/1967 | Mullen | 324/43 |
| 3,408,493 | 10/1968 | Westover et al. | 246/249 |
| 3,641,552 | 2/1972 | Friberg | 340/274 |
| 3,878,539 | 4/1975 | Gooding | 340/546 |
| 4,064,452 | 12/1977 | Toth | 324/202 |
| 4,210,889 | 7/1980 | Holce | 335/207 |
| 4,365,196 | 12/1982 | Finch | 324/207 |
| 4,661,805 | 4/1987 | Salzer | 340/545 |
| 4,866,377 | 9/1989 | Macovschi | 324/202 |
| 4,908,604 | 3/1990 | Jacob | 340/539 |

*Primary Examiner*—Thomas Mullen
*Assistant Examiner*—Benjamin C. Lee
*Attorney, Agent, or Firm*—Luis M. Ortiz; James H. Chafin; William R. Moser

[57] ABSTRACT

A self-testing device is provided for a monitoring system for monitoring whether a closure member such as a door or window is closed. The monitoring system includes a switch unit mounted on the frame of the closure member being monitored and including magnetically biased switches connected in one or more electrical monitoring circuits, and a door magnet unit mounted on the closure member being monitored. The door magnet includes one or more permanent magnets that produce a magnetic field which, when the closure member is closed, cause said switches to assume a first state. When the closure member is opened, the switches switch to a second, alarm state. The self-testing device is electrically controllable from a remote location and produces a canceling or diverting magnetic field which simulates the effect of movement of the closure member from the closed position thereof without any actual movement of the member.

20 Claims, 4 Drawing Sheets

SELF-TESTING SECURITY SENSOR FOR MONITORING CLOSURE OF VAULT DOORS AND THE LIKE

The United States Government has rights in this invention pursuant to Contract No. DE-AC04-91AL65030 between Mason & Hanger-Silas Mason Co., Inc. and the United States Department of Energy.

FIELD OF THE INVENTION

The present invention relates to security devices for monitoring opening barriers using balanced magnetic security switches as part of the monitoring means and, more particularly, to an electromagnetic self-testing apparatus for simulating the opening and closing of vault doors, and the like, equipped with such balanced magnetic switches in a security system.

BACKGROUND OF THE INVENTION

A balanced magnetic door security switch is typically constructed using one or more reed switches or relays arranged within the switch housing or casing. These reed relays respond only to a permanent magnet moved, or otherwise placed near, to the reed contacts of the relay within a tolerance band in the horizontal, vertical and radial planes. As is well known, and is described in more detail in one or more of the patents discussed below, in a common, normally open (NO) implementation of such a relay switch or relay, the reed contacts or reeds of the reed relay are normally spaced apart in physically overlapping relation and when a moveable permanent magnet is placed in correct relation thereto, the reeds are pulled together by the north-south magnetic flux induced into the reeds. With the reeds on contact, i.e., in the closed state of the switch or relay, current will flow therethrough, thereby completing the circuit in which the switch is located. The size of the switch assembly is determined by the amount of current required to flow through the switch and, for security door applications, the current requirement for driving the input of the system computer is very small and thus the reed switch assembly can be small in size (e.g., as small as ½ inch long and ⅛ inch in diameter).

In another common, normally closed (NC) configuration, a small permanent magnet is placed near to the reed switch or relay which biases or drives the reeds into the closed state. When a further, moveable permanent magnet is placed in correct relation with respect to reed switch and fixed permanent magnet, the flux of the moveable magnet will cancel that of the fixed magnet and the reeds will be driven to the open state thereof.

A commercial security door switch system uses combinations of such switches to form a complex electrical circuit. The circuit provides a narrow positioning tolerance band for the moveable magnet assembly, with the tolerance being typically ⅛ to 1 inch, depending on the plane and movement requirements.

Referring now to the patented prior art, U.S. Pat. No. 4,210,889 (Holce) discloses a door switch unit similar to those used commercially in the security industry today, and reference is made to that patent for a more complete description of such door switch units and associated security systems. U.S. Pat. No. 4,908,604 (Jacob) discloses a remotely controlled security system including a test mode wherein each of a plurality of entrance monitors is checked by individually opening each door or window being monitored, which results in the production of a characteristic beep. U.S. Pat. No. 3,641,552 (Friberg) discloses a centrally located access alarm security system including a door sensor device and employing a test switch which, when open, provides triggering of each channel for simultaneous testing of the associated circuitry, indication lamps and audible alarm.

Other patents of possible interest include U.S. Pat. No. 4,365,196 (Finch); U.S. Pat. No. 3,408,493 (Westover et al); U.S. Pat. No. 4,064,452 Toth); U.S. Pat. No. 4,866,377 (Macovschi); and U.S. Pat. N (Mullen). The Finch patent discloses a magnetic proximity sensing transducer for railway crossing signalling installations or for sensing articles on a conveyor line. The transducer is responsive to changes in a magnetic field produced thereby caused by the proximity of an article and, to enable field checking, a field disturbing means is provided for creating an additional field which simulates the disturbance of the magnetic field that would be caused by the proximity of the article. The Westover et al patent discloses a transducer interrogator for a railway wheel transducer which continuously monitors the operation of a magnetic circuit using a saturable reactor located in the magnetic field of a wheel trip. The Toth patent discloses an eddy current defect simulator which controllably alters an electromagnetic field near the detector probe of an eddy current inspection system. The Macovschi patent discloses a proximity detector wherein checking of the functioning thereof is effected by alternately starting and stopping a detector oscillator. The Mullen patent discloses a magnetic detection apparatus using magnetic switches, and static and varying bias fields.

SUMMARY OF THE INVENTION

Generally speaking, the present invention provides for electronically simulating the opening and closing of vault doors and other closure members equipped with biased magnetic switches for security intrusion detection. The self-test simulation provided eliminates the manpower required to physically open and close these doors as is done during conventional security operational testing. Security reliability is enhanced by providing the capability of testing the switches at relatively short intervals (e.g. every eight hours) instead of the weekly or monthly testing normally provided. It will be understood that although vault doors are of primary concern and doors are referred to in the discussions which follow, the invention is applicable to other closure members such as windows.

According to the invention, a testing device is provided for a door closure monitoring system for a security alarm unit including an alarm which is activated when a door being monitored is opened, the monitoring system including a switch unit adapted to be mounted on a frame part of a door being monitored and including at least one magnetically biased switch connected in at least one electrical monitoring circuit including an alarm and switchable between first and second states, and a door magnet unit adapted to be mounted on the door being monitored and including at least one magnet means for, when the door is closed, causing the switch to assume said first state, the switch assuming said second state when the door is opened, said testing device comprising self-testing means controllable from a remote location for magnetically simulating the effect of movement of the door from the closed position thereof without any actual movement of the door so as to test the response of the system to opening the door.

The at least one magnet means preferably generates a magnetic flux for causing said switch to assume said first state and the self-testing means preferably comprises magnetic means for generating a magnetic flux which cancels or provides diversion of the magnetic flux produced by said at least one magnet means.

In one embodiment, the magnet means comprises a permanent magnet producing a magnetic flux for retaining the switch in said first state and the self-testing means comprising a magnetic coil for, when energized from said remote location, producing a flux field which reduces the effect of the flux field produced by the permanent magnet to an extent that enables switching of the switch from said first state thereof to said second state thereof. In one advantageous implementation, the magnetically biased switch comprises a reed switch and a biasing magnet for biasing the reed switch into said second state thereof. In one embodiment, the magnetic coil is disposed adjacent to the reed switch, while in another embodiment, the magnetic coil is disposed around the biasing magnet.

In accordance with a further embodiment of the invention, the least one magnet means comprises at least one electromagnet and the self-testing means comprises means connected to said at least one electromagnet for reducing the current flow thereto so as to simulate the effect of movement of the door from the closed position thereof. Advantageously, the door switch unit further comprises a tamper switch mounted therein.

In accordance with a further embodiment, the least one magnet means comprises at least one permanent magnet for producing a magnetic flux and the self-testing means comprises at least one electromagnet mounted within the door magnet unit for generating a magnetic flux which reduces the effect of the magnetic flux produced by the at least one permanent magnet by substantially canceling the latter or causing diversion thereof. In this embodiment, the door unit preferably further comprises a tamper switch mounted therein. Advantageously, a plurality of permanent magnets are provided and an electromagnet is disposed adjacent each of the electromagnets. In another implementation, electromagnets are disposed between pairs of the permanent magnets.

Other features and advantages of the invention will be set forth in, or apparent from, the following detailed description of preferred embodiments of the invention.

BRIEF DESCRIPTION OF THE DRAWINGS

The foregoing summary, as well as the following detailed description of preferred embodiments of the invention, will be better understood when read in conjunction with the appended drawings. It should be understood, however, that the invention is not limited to the precise arrangements and instrumentalities shown.

DESCRIPTION OF THE PREFERRED EMBODIMENTS

Figure 1:
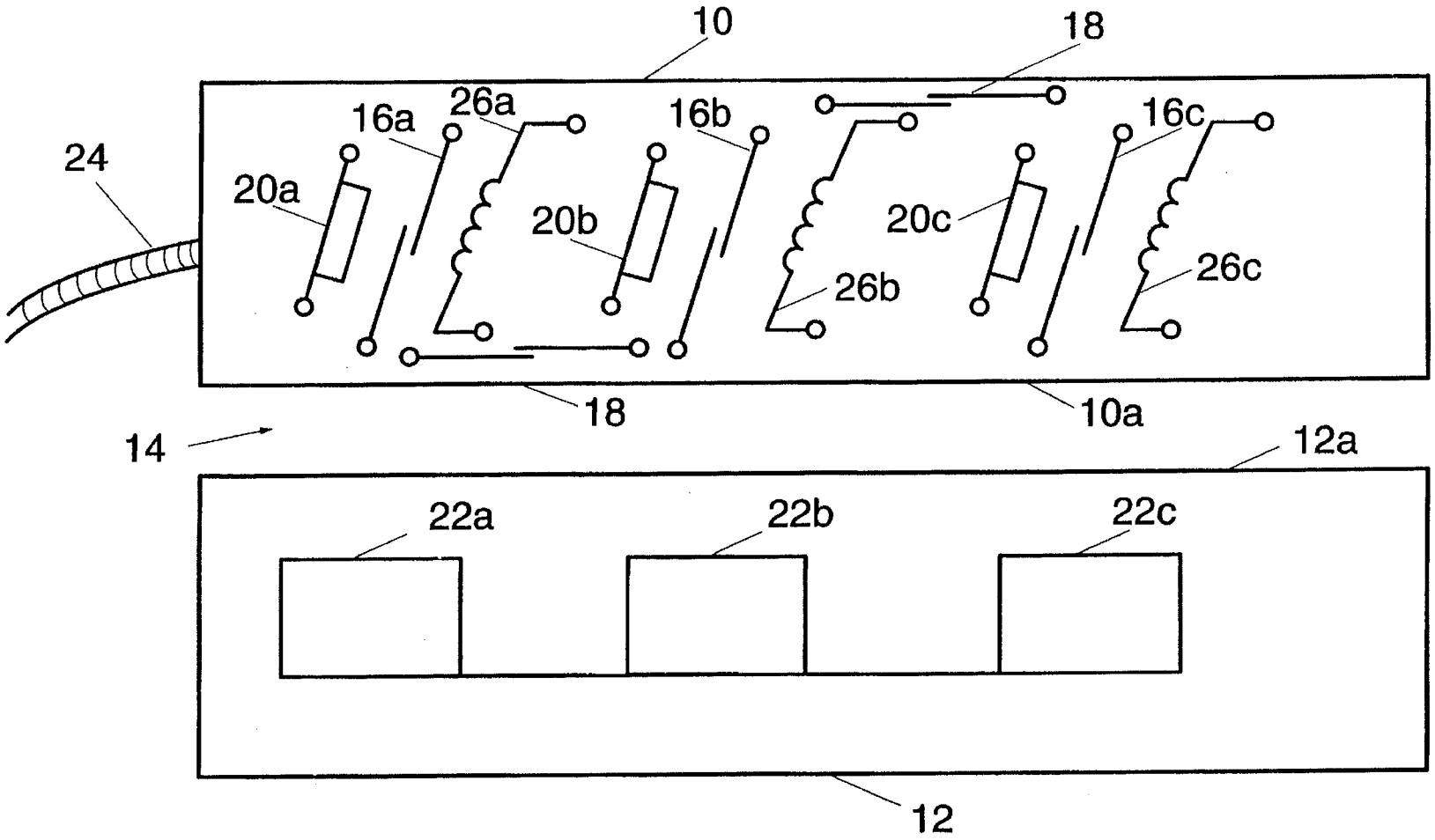
FIG. 1 is a schematic representation of a door monitoring assembly constructed in accordance with a first embodiment of the invention and including a switch unit and a switch activating or door magnet unit.

Referring to FIG. 1, a schematic representation is provided of a first embodiment of the self-testing door switch system of the invention. The system includes a switch unit, generally denoted 10, and a switch actuating or activating unit, generally denoted 12. In a typical installation the switch unit 10 would be mounted on the frame of a vault door while the actuating unit 12 would be mounted on the vault door itself. As discussed in the Holce patent referred to above, the units typically include a protective housing, indicated, respectively at 10*a* and 12*a*, which are affixed by screws or the like (not shown) to the frame and door, respectively, in spaced relationship so that a small gap 14 exists therebetween.

Switch unit 10 includes a plurality of reed switches 16*a*, 16*b* and 16*c* mounted therein and may advantageously also include other protective reed switches such as pry tamper switches indicated at 18. Typically, the main reed switches 16*a*, 16*b* and 16*c* are effectively connected in series in a circuit configuration including a closed loop conductor and a pair of intermediate conductors, as disclosed in the Holce patent, while switches 18 are connected in series in a further, separate monitoring circuit. Other circuit connections can, of course, be used and, for example, the rightmost switch 16*c* can be a point identification switch while the leftmost switches 16*a* and 16*b* can be connected in a supervised circuit. It will be understood that such connections are conventional and the configuration in which switch the switches 16*a*, 16*b* and 16*c* are connected in the overall supervisory system forms no part of the present invention.

A like plurality of bias magnets 20*a*, 20*b* and 20*c* are disposed in proximity to respective switches 16*a*, 16*b* and 16*c* are used to establish the normally closed (NC) state of the associated reed switches when the door magnet unit or assembly 12 is not in place. The biasing magnets can, for example, be made of Alnico V and Alnico VII. The door magnet unit or magnetic switch actuating unit 12 includes a like plurality of actuating or door magnets 22*a*, 22*b* and 22 in alignment with the locations of respective reed switches 16*a*, 16*b* and 16*c*, as illustrated. Actuating magnets, which can be made of the same material as bias magnets 20*a*, 20*b* and 20*c*, provide a magnetic field having a strength exceeding that of the bias magnets 20*a*, 20*b* and 20*c* and, with actuating magnets 22*a*, 22*b* and 22*c* in place, i.e., in the position shown in FIG. 1 representing the closed state of the vault door, the reed switches 16*a*, 16*b* and 16*c* are driven to the normally open (NO) state thereof, which is the secure state. When the door is opened, door magnets 22*a*, 22*b* and 22*c* will move away from the illustrated positions thereof in proximity to switches 16*a*, 16*b* and 16*c*, the flux field produced magnets 22*a*, 22*b* and 22*c* will be reduced, and the switches 16*a*, 16*b*, and 16*c* will be closed, which is the alarm state, so that an alarm (not shown) will be activated. A cable 24 connects the circuitry of the switch 10 to a conventional security control system and alarm unit (not shown) such as described above.

It again will be appreciated that the system described thus far is conventional and variations in the specific embodiment, just described can, of course, be effected. For example, the reed switches can be replaced by Hall effect switches or relays.

In accordance with the embodiment of the invention illustrated in FIG. 1, a further like plurality of self-test coils 26*a*, 26*b* and 26*c* are added to the system which enable self-testing of the system. Coils 26*a*, 26*b* and 26*c*, when energized, have a magnetic polarity opposite to that of the door magnets 20*a*, 20*b* and 20*c* and thus, when these coils are energized, flux cancellation and flux diversion will occur in an amount or to an extent such that the magnetic biasing forces produced by bias magnets 20*a*, 20*b* and 20*c* are dominant and thus the reed switches 16*a*, 16*b* and 16*c* will return to the NC (alarm) state.

It will be appreciated that the test operation provided is a true stimulation of the attendant sensing and reporting during the time during which the self-test coils 26*a*26*b* and 26*c* are energized, and that no other functions of the switches or of the overall system will change. The location of the self-test coils 26*a*, 26*b* and 26*c* close to the reed switches 16*a* 16*b* and 16*c* reduces the coil sizes and the amount of current required to cancel and divert the flux from the door magnets 22*a*, 22*b* and 22*c*.

Figure 2:
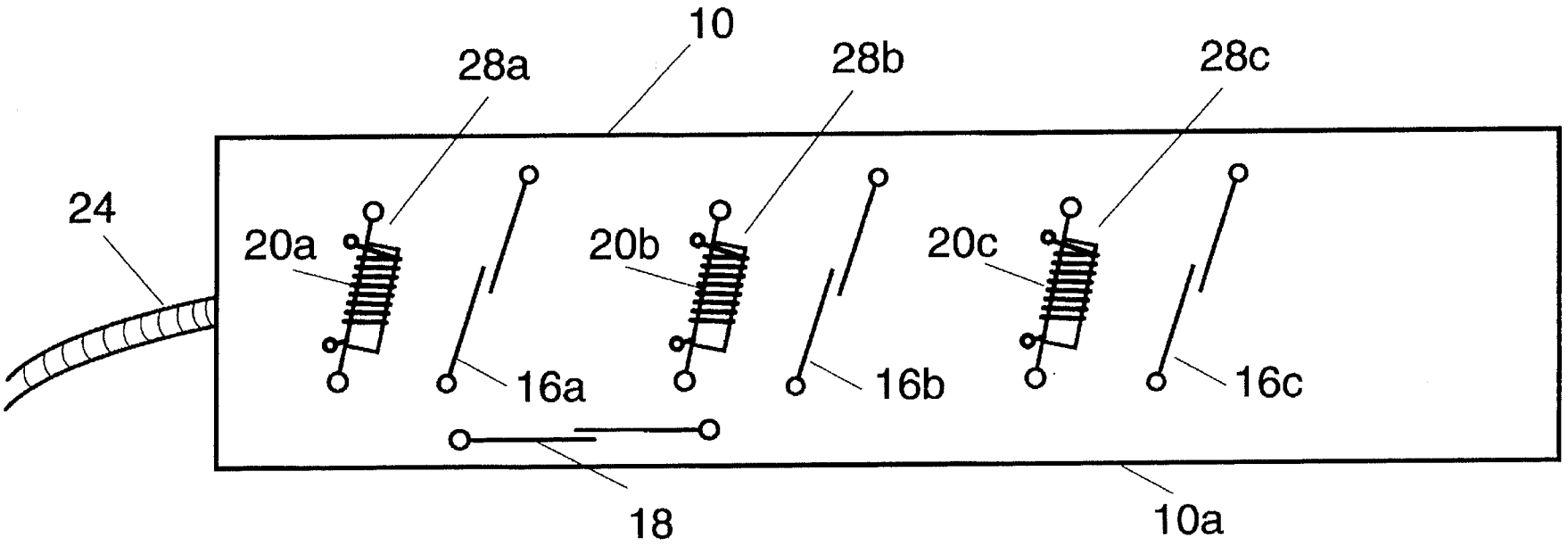
FIG. 2 is a schematic representation of an alternative embodiment of the switch unit of FIG. 1.

Referring to FIG. 2, a further embodiment of the invention is illustrated. The door unit is unchanged for this embodiment and thus is not shown. This embodiment is similar to that of FIG. 1 and like elements have been given the same reference numerals. The optional tamper pry switches have been omitted for the sake of simplicity. The embodiment of FIG. 2 differs from that of FIG. 1 in that, in place of coils 26*a*, 26*b* and 26*c* of FIG. 1, coils 28*a*, 28*b* and 28*c* are added which are wired and arranged so as to generate a magnetic flux field with the same polarity as the bias magnets 20*a*, 20*b* and 20*c* so the magnetic flux fields add. With this approach, when the reed switches 16*a*, 16*b* and 16*c* are in the secure (open) state and the self-test coils 28*a*, 28*b* and 28*c* are energized, the total flux density of the coils 28*a*, 28*b* and 28*c*, on the one hand, and the bias magnets 20*a*, 20*b* and 20*c*, on the other hand, are added together. The resultant flux density is greater than that of the door magnets 22*a*, 22*b* and 22*c* and thus the reed switches 16*a*, 16*b* and 16*c* are driven to the alarm (closed) state while coils 28*a*, 28*b* and 28*c* are energized.

Figure 3:
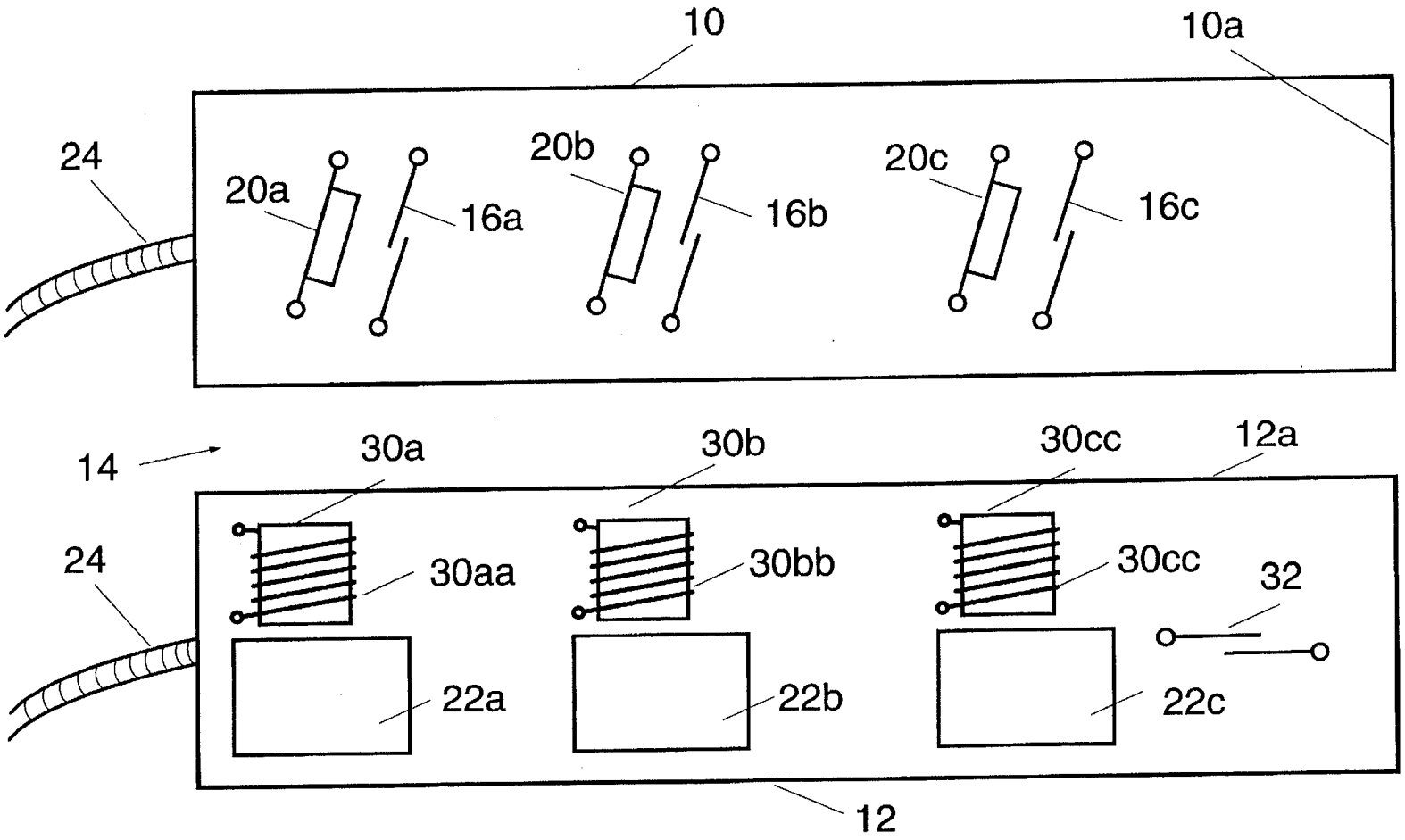
FIG. 3 is a schematic representation of a further embodiment of the door monitoring assembly of the invention.

Referring to FIG. 3, a further embodiment is shown. Again, in this embodiment like reference numerals are used for the corresponding elements of the other figures, and in this embodiment, a tamper reed switch 32 has been added to the door unit 12. However, the chief difference between this embodiment and the previous embodiments is that additional self-test coils, coils 30*a*, 30*b* and 30*c* have been added to the door magnet unit 12, and not to the switch unit 10, so that the self-test stimulation is provided at the door magnet unit 12. A second cable 24' is used to provide the necessary connections to the pry tamper switch 32 and the coils 30*a*, 30*b*, and 30*c*.

The embodiment of FIG. 3 provides enhanced security over the embodiments described above for several reasons. First, the pry tamper circuit including pry tamper switch 32 will cause a tamper alarm to be generated where an attempt is made to remove the door magnet unit 12. This is important because with other door switch magnet units, including those which are specifically designed to precision match the reed switch or Hall effect switches used, the door magnet unit can be removed and attached to a sensor body simulating a closed door. Second, when a self-test is undertaken, it is known that door magnet unit 12 is in place and the door is closed. Third, a "sensor functional" status can be verified if for some reason a tamper alarm or false alarm occurs within the system. This functional test preferably comprises a time window software generated, and operator initiated, test.

The embodiment of FIG. 3 uses flux cancellation and diversion as in the other embodiments. However, coils 30*a*, 30*b* and 30*c* are preferably larger magnetic coils wound on respective permeable cores 30*a*, 30*b* and 30*c*. These cores couple lines of flux to the reed switches 16*a*, 16*b*, and 16*c*, in the (open) secure state wherein the door is closed. The door switch operation will not be affected. When coils 30*a*, 30*b* and 30*c* are energized as a group or individually, the respective circuit or circuits associated with these coils will be tested by virtue of the reduction of the magnetic lines of flux induced into the switch unit 10. This occurs because the self-test coils 30*a*, 30*b* and 30*c* are wired so as to induce opposing lines of flux into the respective permeable cores 30*a*, 30*b* and 30*c*, thereby canceling and deflecting lines of flux generated by the permanent magnets 22*a*, 22*b* and 22*c*. This has the effect of stimulating the sensing and alarm unit (not shown) in the same manner as opening the door.

Figure 4:
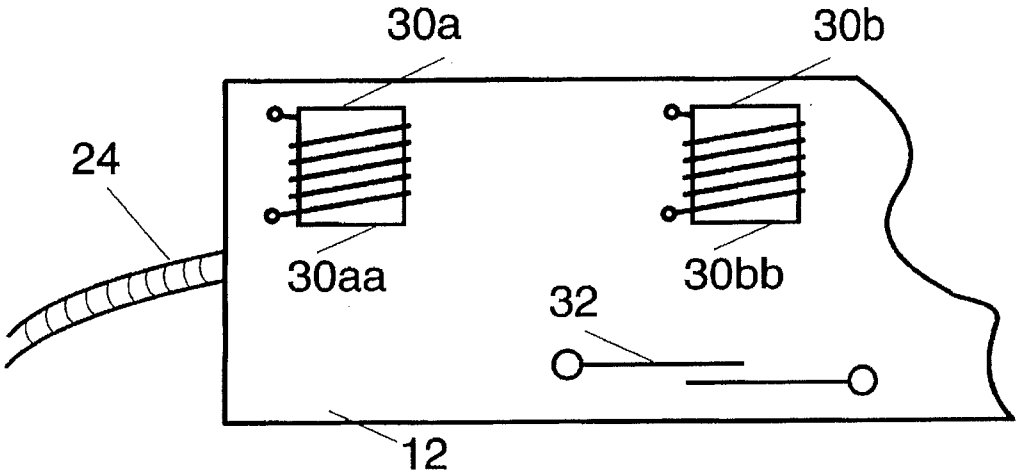
FIG. 4 is a schematic representation, partially broken away, of an alternative embodiment of the switch activating unit of FIG. 3.

Referring to FIG. 4, an embodiment similar to that of FIG. 3 is illustrated wherein electro-magnets, only two which 30*a* and 30*b* are shown, are energized to stimulate the associated reed switch (not shown) and the door magnets used in the embodiment of FIG. 3 are omitted. The self testing (and the functional test) is initiated by reducing the current to either one or all of the electromagnets 30*a* and 30*b*. This embodiment is particularly useful where a magnetic switch (such as a Hall effect switch) is used which requires external power for switch operation. This embodiment could also employ a random subtle modulation of the magnet power supply that would be sensed by the associated reed, solid state, or Hall effect switches and compared to provide correct sensor operation and status indications.

Figure 5:
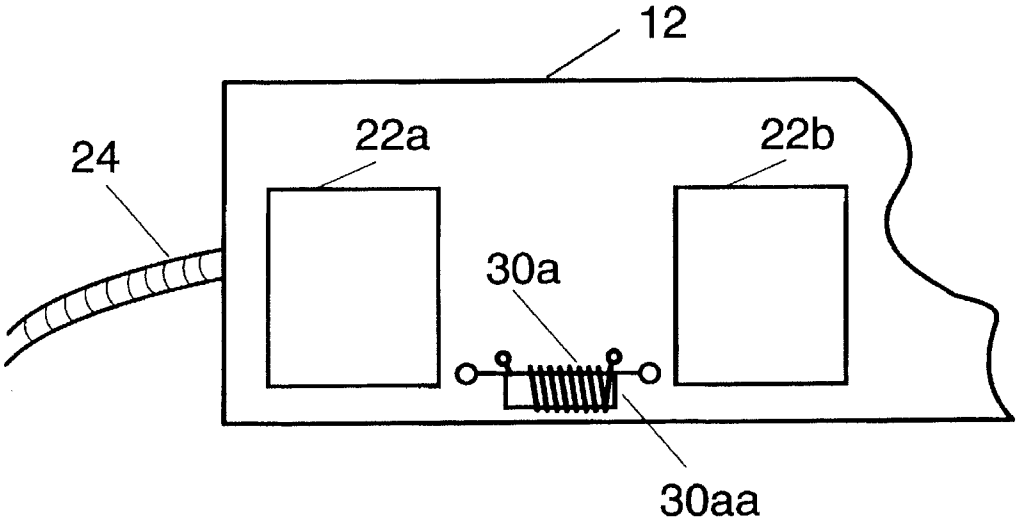
FIG. 5 is a schematic representation, partially broken away, of a further alternative embodiment of the switch activating unit of FIG. 3.

Referring to FIG. 5, yet another embodiment is shown. In this embodiment, the electromagnets are disposed between the door magnets, as is indicated by electromagnet formed by coil 30*a* and coil 30*aa* disposed between magnets 22*a* and 22*b*. The electromagnets generate opposing lines of flux which reduce the effect of the permanent magnets on the associated reed switches so as to drive the switches into the alarm state thereof.

Although the present invention has been described relative to specific exemplary embodiments thereof, it will be understood by those skilled in the art that variations and modifications can be effected in these exemplary embodiments without departing from the and spirit of the invention as defined by the appended claims.

What is claimed is:

1. A self-testing security device and monitoring system for closure monitoring, comprising:

a) a switch unit adapted to be mounted on a frame part for a moveable panel being monitored and comprising at least one magnetically biased switch connected to at least one electrical monitoring circuit, said switch unit switchable between first and second states;

b) a magnet means adapted to be mounted on the moveable panel being monitored, said magnet means comprising at least one magnet for enabling said switch unit to assume said first state when said moveable panel is closed with respect to said frame part and for causing said switch to assume said second state when said moveable panel is opened with respect to said frame part;

c) a self-testing means for magnetically simulating the effect of movement of the moveable panel from the closed position to the open position without any actual movement of said moveable panel so as to test the response of the system to movement of said moveable panel; and d) an alarm indicating means which is activated when said moveable panel being monitored is actually or simulated to be moved from the closed state to the opened state.

2. The invention of claim 1 wherein said magnet means generates a magnetic flux for causing said switch to assume said first state and wherein said self-testing means comprises magnetic means for generating a magnetic flux which cancels or diverts the magnetic flux produced by said magnet means.

3. The invention of claim 1 wherein said self-testing means is controllable from a remote location.

4. The invention of claim 1 wherein said magnet means comprises at least one electromagnet and said self-testing means comprises a current reducing means connected to said at least one electromagnet for reducing the current flow thereto so as to simulate movement of said moveable member from a closed position with respect to said frame part.

5. The invention of claim 1 further comprising a tamper switch.

6. The invention of claim 1 wherein said magnet means comprises at least one permanent magnet for producing a first magnetic flux and said self-testing means comprises at least one electromagnet mounted within a door magnet unit for generating a second magnetic flux which reduces the effect of said first magnetic flux produced by said at least one permanent magnet.

7. The invention of claim 6 wherein said second magnetic flux produced by said at least one electromagnet substantially cancels said first magnetic flux produced by said at least one permanent magnet.

8. The invention of claim 6, wherein said second magnetic flux produced by said at least one electromagnet causes diversion of said first magnetic flux produced by said permanent magnet.

9. The invention of claim 6 further comprising a tamper switch mounted in an actuating unit and mounted on a vault door.

10. The invention of claim 6 wherein said at least one permanent magnet comprises a plurality of permanent magnets and wherein a said electromagnet is disposed adjacent each of said permanent magnets.

11. The invention of claim 6 wherein said at least one permanent magnet comprises a plurality of permanent magnets and wherein a said at least one electromagnet is disposed between said plurality of permanent magnets.

12. The invention of claim 1 wherein said magnet means comprises a magnet for producing a magnetic flux for retaining said switch in said first state and said self-testing means comprises a magnetic coil for producing a flux field which reduces the effect of the flux field produced by magnet to an extent that enables switching of said switch from said first state thereof to said second state thereof.

13. The invention of claim 12 wherein said switch unit comprises a reed switch and a biasing magnet for biasing said reed switch into said second state thereof.

14. The invention of claim 13 wherein said biasing magnet is disposed adjacent to said reed switch.

15. The invention of claim 13 wherein a magnetic coil is disposed around said biasing magnet.

16. A security device and monitoring system for monitoring the closed status of a door, comprising:

(a) a switch means adapted to be mounted on a door frame of a door being monitored, said switch means further comprising at least one magnetically biased switch connected to at least one electrical monitoring circuit including an alarm means wherein said switch means is switchable between first and second states;

(b) a magnet means to be mounted on the said door, said magnet means further comprising at least one magnet for causing said switch to assume said first state when said closure member is closed with respect to said door frame, and for causing said switch means to assume said second state when said door is opened with respect to said door frame;

(c) a self-testing means controllable from a remote location for magnetically simulating the effect of movement of said door from said door frame so as to test the response of said system to said opening of said door, wherein said at least one magnet further comprises at least one permanent magnet for producing a first magnetic flux and said self-testing means comprises at least one electromagnet mounted within said magnet means for generating a second magnetic flux which reduces the effect of the first magnetic flux produced by said at least one permanent magnet;

(d) a tamper means for detecting tampering to said security system; and wherein the alarm means is activated when the door being monitored is actually or simulated to be opened or when said security system is being tampered with.

17. The invention of claim 16 wherein the magnetic flux produced by said at least one electromagnet substantially cancels the magnetic flux produced by said permanent magnet.

18. The invention of claim 16 wherein the magnetic flux produced by said at least one electromagnet causes diversion of the magnetic flux produced by said permanent magnet.

19. A testing device as claimed in claim 16 wherein said at least one permanent magnet comprises a plurality of permanent magnets and wherein a said electromagnet is disposed adjacent each of said permanent magnets.

20. A self-testing device and monitoring system for panel closure monitoring, comprising:

a) a switch unit adapted to be mounted on a frame part for a moveable panel being monitored, said switch unit further comprising at least one magnetically biased switch connected to at least one electrical monitoring circuit, said switch unit switchable between first and second states;

b) a magnet unit adapted to be mounted on a moveable panel being monitored by said security system, said magnet unit further comprising at least one magnet for enabling said switch unit to assume said first state when said moveable panel is closed with respect to said frame part and for causing said switch to assume said second state when said moveable panel is opened with respect to said frame part, wherein said at least one magnet generates a magnetic flux for causing said switch to assume said first state;

c) a self-testing means controllable from a remote location for magnetically simulating the effect of movement of the moveable panel from the closed position to the open position without any actual movement of said moveable panel so as to test the response of the system to movement of said moveable panel, wherein self-testing means comprises magnetic means for generating a magnetic flux which cancels or diverts the magnetic flux produced by said magnet means;

d) a tamper means for detecting tampering to said security system; and e) an alarm indicating means which is activated when said moveable panel being monitored is actually or simulated to be moved from the closed state to the opened state or when said security system is being tampered with.

* * * * *